US005806855A

United States Patent [19]

Cherry

[11] Patent Number: 5,806,855

[45] Date of Patent: Sep. 15, 1998

[54] POKER WAGERING GAME

[75] Inventor: Eric Cherry, Highland Beach, Fla.

[73] Assignee: Horse Sense Corporation, Delray Beach, Fla.

[21] Appl. No.: 879,850

[22] Filed: Jun. 20, 1997

[51] Int. Cl.[6] ..... A63F 1/00

[52] U.S. Cl. ..... 273/292; 463/13

[58] Field of Search ..... 273/292, 303, 273/304, 305, 306, 274; 463/13

[56] References Cited

U.S. PATENT DOCUMENTS

| | | | |
|---|---|---|---|
| 3,618,952 | 11/1971 | Tallarida | 273/135 B |
| 4,092,029 | 5/1978 | Jones | 273/271 |
| 4,732,393 | 3/1988 | Rita | 273/269 |
| 4,856,788 | 8/1989 | Fischel | 273/256 |
| 4,909,516 | 3/1990 | Kolinsky | 273/237 |
| 5,022,653 | 6/1991 | Suttle et al. | 273/85 CP |
| 5,288,077 | 2/1994 | Jones | 273/292 |
| 5,374,067 | 12/1994 | Jones | 273/292 |
| 5,377,973 | 1/1995 | Jones et al. | 273/85 CP |
| 5,380,012 | 1/1995 | Jones et al. | 273/292 |
| 5,382,025 | 1/1995 | Sklansky et al. | 273/292 |
| 5,536,016 | 7/1996 | Thompson | 273/269 |
| 5,544,892 | 8/1996 | Breeding | 273/292 |
| 5,657,993 | 8/1997 | Merlino et al. | 273/292 |
| 5,660,392 | 8/1997 | Hansen | 273/292 |
| 5,664,781 | 9/1997 | Feola | 273/292 |
| 5,669,606 | 9/1997 | Brown | 273/292 X |
| 5,718,431 | 2/1998 | Ornstein | 273/292 |
| 5,725,216 | 3/1998 | Jones | 273/292 |

FOREIGN PATENT DOCUMENTS

WO 98/09693 3/1998 WIPO .

OTHER PUBLICATIONS

Seminole Indian Bingo Rules for Lightning Bingo (one page) prior to Jul. 11, 1996.

Eric Cherry et al., U.S. Serial No. 08/707,110, filed Sep. 3, 1996 (pending).

*Primary Examiner*—William E. Stoll

*Attorney, Agent, or Firm*—Fish & Richardson P.C.

[57] ABSTRACT

A wagering game is played by a player by providing an initial set of betting chips to the player. A quantity of cards is dealt from a deck of cards equal to a quantity of hands, each of the cards being dealt in one of a plurality of dealing groups to form the hands. The player places a wager on one of the quantity of hands based on a subset of the initial set of betting chips, the subset of wagering chips being removed from the initial set of wagering chips. The placing and dealing steps are repeated until a predetermined number of cards has been dealt in a number of dealing groups equal to the predetermined number to complete the hands. The highest ranking hand is determined, and a payout to the player is calculated based on the sequence of dealing groups, the payout for each of the player's betting chips depending upon the dealing group for which the chip was wagered. The game may be implemented as an electronic game played at an electronic gaming device.

29 Claims, 5 Drawing Sheets

| CHIP WAGERED PRIOR TO DEALING GROUP | PAYOUT PER CHIP |
|---|---|
| 1 | 5:1 |
| 2 | 4:1 |
| 3 | 3:1 |
| 4 | 2:1 |
| 5 | 1:1 |

| CHIP WAGERED PRIOR TO DEALING GROUP | PAYOUT PER CHIP |
|---|---|
| 1 | 5:1 |
| 2 | 4:1 |
| 3 | 3:1 |
| 4 | 2:1 |
| 5 | 1:1 |

FIG. 3

POKER WAGERING GAME

BACKGROUND OF THE INVENTION

This invention relates to a wagering game, and in particular, a poker game with a variable payout wagering scheme.

In a traditional poker game, each of a plurality of players is dealt a hand of five cards from a deck of 52 standard playing cards. The player with the best hand of cards, compared with the hands dealt to the other players, is deemed the winner. Hands are ranked on the basis of the face values and suits of the cards in the hands. For example, a hand having three cards of the same face value, i.e. "three of a kind," beats a hand with two pairs of cards with the same face value, each pair having different face values, i.e. "two pairs."

Players typically use betting chips purchased from the "house" to place wagers prior to and during play of the game. Players wager that their hands will be the best hand. A payout is paid to the player with the best hand based on the totality of wagers placed by all players who continue to place wagers during the game.

SUMMARY OF THE INVENTION

In general, in one aspect, the invention features a method of playing a wagering game by a player. An initial set of betting chips is provided to the player. A quantity of cards are dealt from a deck of cards equal to a quantity of hands, each of the cards being dealt in one of a plurality of dealing groups to form the hands. The player places a wager on at least one of the quantity of hands based on a subset of the initial set of betting chips, the subset of wagering chips being removed from the initial set of wagering chips. The placing and dealing steps are repeated until a predetermined number of cards has been dealt in a number of dealing groups equal to the predetermined number to complete the hands. The highest ranking hand is determined, and a payout to the player is calculated based on the sequence of dealing groups, the payout for each of the player's betting chips depending upon the dealing group for which the chip was wagered.

Implementations of the invention may also include one or more of the following features. Each wager placed by the player may be placed on any one or more than one of the quantity of hands. Each wager placed by the player may be placed prior to one of the dealing groups. The highest ranking hand may be determined according to standard poker rules.

The payout for a betting chip wagered for a first dealing group may be greater than the payout for a betting chip wagered for a final dealing group. The payout for a betting chip wagered for each dealing group may be greater than the payout for a betting chip wagered for a next dealing group.

The method may include wagering a betting chip as an ante. The player may have to wager all of the initial set of betting chips prior to a final dealing group.

The wagering game may be a casino game or an electronic game. The deck of cards may be a standard deck of 52 playing cards. The cards may be dealt by a dealer.

The game may include maintaining a progressive jackpot which is paid to the player if the player places a wager on a hand that includes a certain combination of cards.

The predetermined number may be five. The quantity of hands may be seven. The cards may be dealt face up.

The game may be played by a plurality of players. All players may start the game with the same number of betting chips.

In general, in another aspect, the invention features an electronic gaming device for playing a wagering game by a player. A screen displays an initial set of betting chips for the player and cards dealt in a plurality of dealing groups to form a quantity of hands, one card being dealt to each hand in each dealing group until a predetermined number of cards has been dealt to the hands. A processor deals the cards from a deck of cards, determines which of the hands is the highest ranking hand, calculates a payout to the player, and provides the payout. The player places a wager on at least one of the quantity of hands based on a subset of the initial set of betting chips for each dealing group, the subset of wagering chips being removed from the initial set of wagering chips. The payout is calculated based on the sequence of dealing groups, the payout for each of the player's betting chips depending upon the dealing group for which the chip was wagered.

Implementations of the invention may also include one or more of the following features. Each wager placed by the player may be placed on any one or more than one of the quantity of hands. Each wager placed by the player may be placed prior to one of the dealing groups. The highest ranking hand may be determined according to standard poker rules.

The payout for a betting chip wagered for a first dealing group may be greater than the payout for a betting chip wagered for a final dealing group. The payout for a betting chip wagered for each dealing group may be greater than the payout for a betting chip wagered for a next dealing group.

The player may have to wager all of the initial set of betting chips prior to a final dealing group. The predetermined number may be five. The quantity of hands may be seven.

The game of the present invention has the advantage that it is a simple game that can be played in casinos and other gaming establishments.

The game of the present invention has the further advantage of allowing players to place variable wagers based on the players' desired levels of risk throughout play of the game.

Other features and advantages of the invention will become apparent from the following detailed description, and from the claims.

BRIEF DESCRIPTION OF THE DRAWINGS

FIG. 3 is a table showing variable payouts for the game of the present invention.

DESCRIPTION OF THE PREFERRED EMBODIMENTS

The wagering game of the present invention involves a wagering scheme for a game similar to a standard poker game. The game may be played with playing cards on a table, such as in a casino environment, or may be played as an electronic game using a computer or video terminal with a screen that displays the playing cards and the players' betting chips.

As used here, the cards may be actual playing cards, or may be electronic or graphical representations of playing cards. Thus, actual cards may be dealt to players, or representations of cards may be displayed, e.g., on a display screen. Similarly, the player's betting chips may be actual betting chips, or may be electronic or graphical representations of betting chips. Actual betting chips may be used to place a wager, or wagers may be based on representations of betting chips, e.g., on a display screen.

Figure 1:
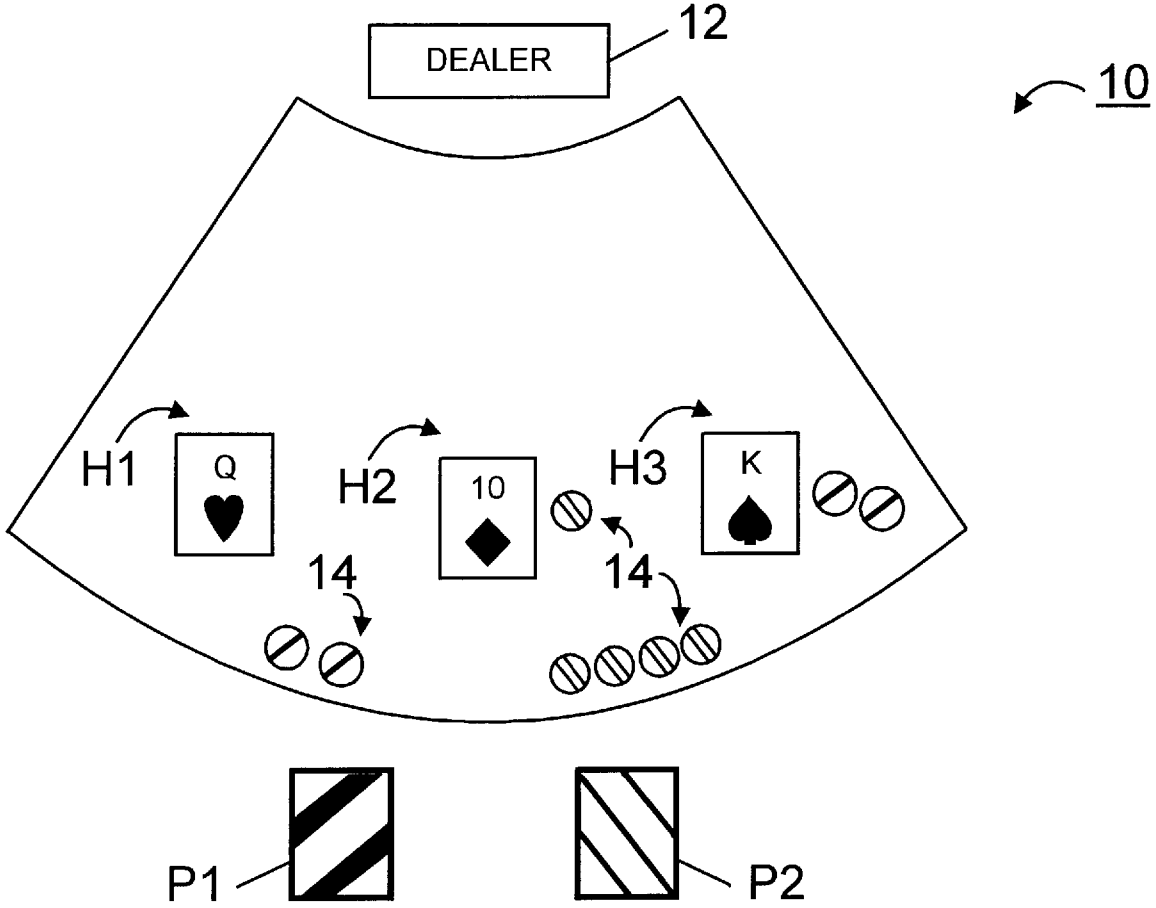
FIG. 1 shows the game of the present invention after one dealing group.

As shown in FIG. 1, game 10 is played with a deck of playing cards, e.g., a standard deck of 52 cards, each card being labeled with one of four suits (hearts, clubs, spades and diamonds) and one of thirteen face values (2 through 10 and jack, queen, king and ace).

The game is played with a plurality of players P1, P2, . . . Pn. FIG. 1 shows two players P1 and P2. The game of the present invention may be conducted by a dealer 12 who represents the "house." The house provides payouts to players for winning wagers. The dealer may also be a player in the game. In a casino environment, dealer 12 may be a person. For an electronic game, dealer 12 may take the form of a computer processor.

In the poker wagering game of the present invention, all players P1,P2 . . . Pn play against each other and the house. However, hands are not dealt to individual players. Instead, a predetermined number of hands H1,H2 . . . Hn is dealt by the dealer, and players may place wagers on any one of the hands. There may be any number of hands, preferably seven, in each game. FIG. 1 shows three hands H1, H2 and H3.

Each hand consists of any number, e.g. five, of cards dealt face up, one at a time. The cards are dealt in groups, in which one card is dealt face up for each hand during each dealing group. In the case of a five card game, the dealer deals five groups of cards so that each hand is formed with a total of five cards.

Each player starts with a set, e.g. five, of betting chips or tokens 14 to wager during the game. All players start each game with the same number of chips. For convenience, all of a player's chips may be of the same color, with each player playing with a set of colored chips of a different color from the chips of other players.

The value of the chips played by each player during a game may vary between players. Thus, one player may start a game with five $1 chips, and another player may start the game with five $5 chips. All of the chips in a player's set for a particular game preferably have the same value. For a subsequent game, players may increase or decrease their wagers, as permitted by the house's wagering limitations, by using a set of chips having a different chip value.

Players P1,P2 . . . Pn place wagers that one of the hands H1,H2 . . . Hn being dealt will be the best hand when the dealing is completed. The basic rule of the game is that each player may wager any number of his remaining betting chips on any one or more hands being dealt for each dealing group. The wager is preferably placed prior to dealing each dealing group, but the wager may be placed during or subsequent to the dealing of each dealing group. Further, a wager placed for a particular dealing group may be split between more than one hand. The player may also have to wager an ante chip prior to the first dealing group. Once a chip is wagered for a particular dealing group of the game, that wager cannot be changed.

As shown in FIG. 1, players P1 and P2 each have five chips at the start of the game. The players may have to wager one chip as an ante, and then may wager up to four additional chips prior to the first dealing group being dealt by the dealer. After each player places an initial wager on one or more of the hands H1, H2, H3, which wager may include an ante, the dealer deals a group of three cards, placing one card face up to form each hand H1, H2 and H3. In the example of FIG. 1, player P1 has wagered two chips on hand H3, and player P2 has wagered one chip on hand H2.

More than one player may place a wager on the same hand for a particular dealing group. For convenience, the players may be able to place their wagers in designated betting areas in front of each player instead of having to place chips next to the actual cards in the hands on which they are placing the wagers.

Figure 2:
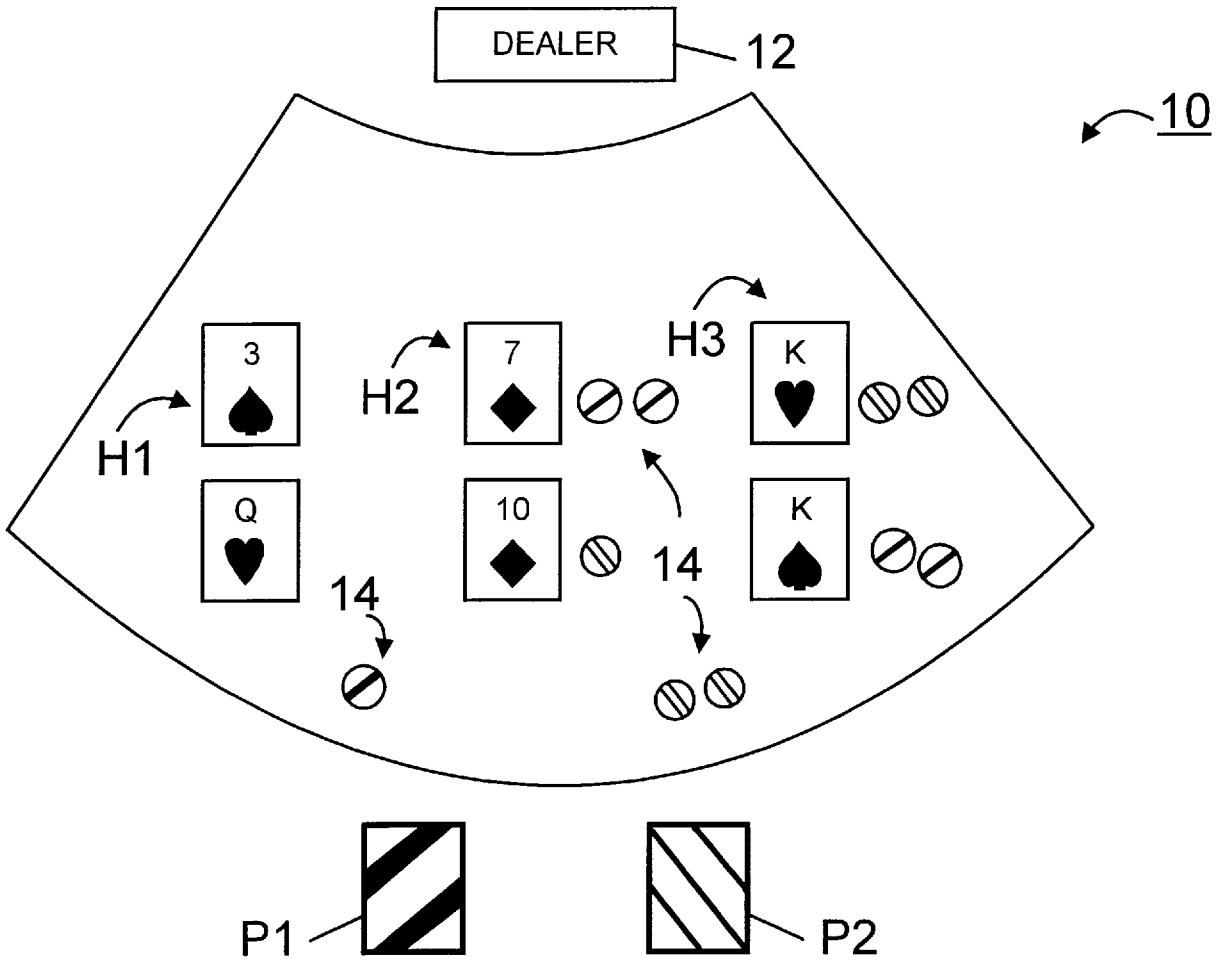
FIG. 2 shows the game of the present invention after two dealing groups.

As shown in FIG. 2, e.g. prior to the second dealing group, each player may place an additional wager that one or more of the hands H1, H2 or H3 will be the best hand when the dealing is completed. The wager may include any number of betting chips in the player's set that have not already been wagered. In placing a wager, a player may consider the cards dealt to the various hands and the likelihood that each of the various hands will be the best hand under the rules of a standard poker game. As shown in FIG. 2, a player's wagered betting chips for each dealing group are separated according to which groups of cards were dealt when the chips were wagered. In the example of FIG. 2, player P1 has placed an additional wager of two chips on hand H2, and player P2 has placed an additional wager of two chips on hand H3 for the second dealing group.

The steps of wagering betting chips and dealing as shown in FIGS. 1 and 2 are repeated until a full hand, e.g. five cards, is dealt face up for each hand. Players must wager all of the chips in their sets prior to the last dealing group. Upon examination of the completed hands, the dealer determines the best hand, i.e. the highest ranking hand according to standard poker rules.

The payout to the players depends on when chips 14 were wagered as the cards were dealt in dealing groups. Payouts may be paid, e.g., by the house. For example, as shown in FIG. 3, any betting chips wagered prior to the first dealing group are assigned a payout of five to one, i.e. five chips of equivalent value are paid for each chip wagered prior to the dealing of the first dealing group. For betting chips wagered after one card is dealt, i.e. prior to the second dealing group, the payout is four to one. As shown in FIG. 3, by the time the last dealing group is being dealt and the players have wagered any remaining chips from the set with which they started, the payout is one to one. Also, the payouts for chips wagered during particular dealing groups may vary.

The basis of this payout scheme is that wagers placed early in the game, when the outcome is more difficult to guess, will be rewarded with higher payouts to the winning player. Of course, wagers placed early in the game are also riskier because the outcome is more difficult to guess. For example, a player starting with five chips may wager two chips on hand H2 prior to the first dealing group, e.g. the player wagers an ante chip and one additional chip. The player may also wager his remaining three chips on hand H2 prior to the third dealing group. Thus, if hand H2 is the highest ranking hand after all the hands have been fully dealt, the payout to the player would be 19 chips, calculated with reference to the payout chart of FIG. 3, as follows:

| Number of chips | | Payout | Total |
|---|---|---|---|
| 2 | × | 5 | 10 |
| 3 | × | 3 | 9 |
| | | Total payout = | 19 |

In addition, the game of the present invention may be played with a progressive jackpot, to which chips are added during each round of play. The progressive jackpot may be an additional payout for a player who places a wager that a particular hand will include of a certain combination of cards, e.g., four of a kind.

Figure 4:
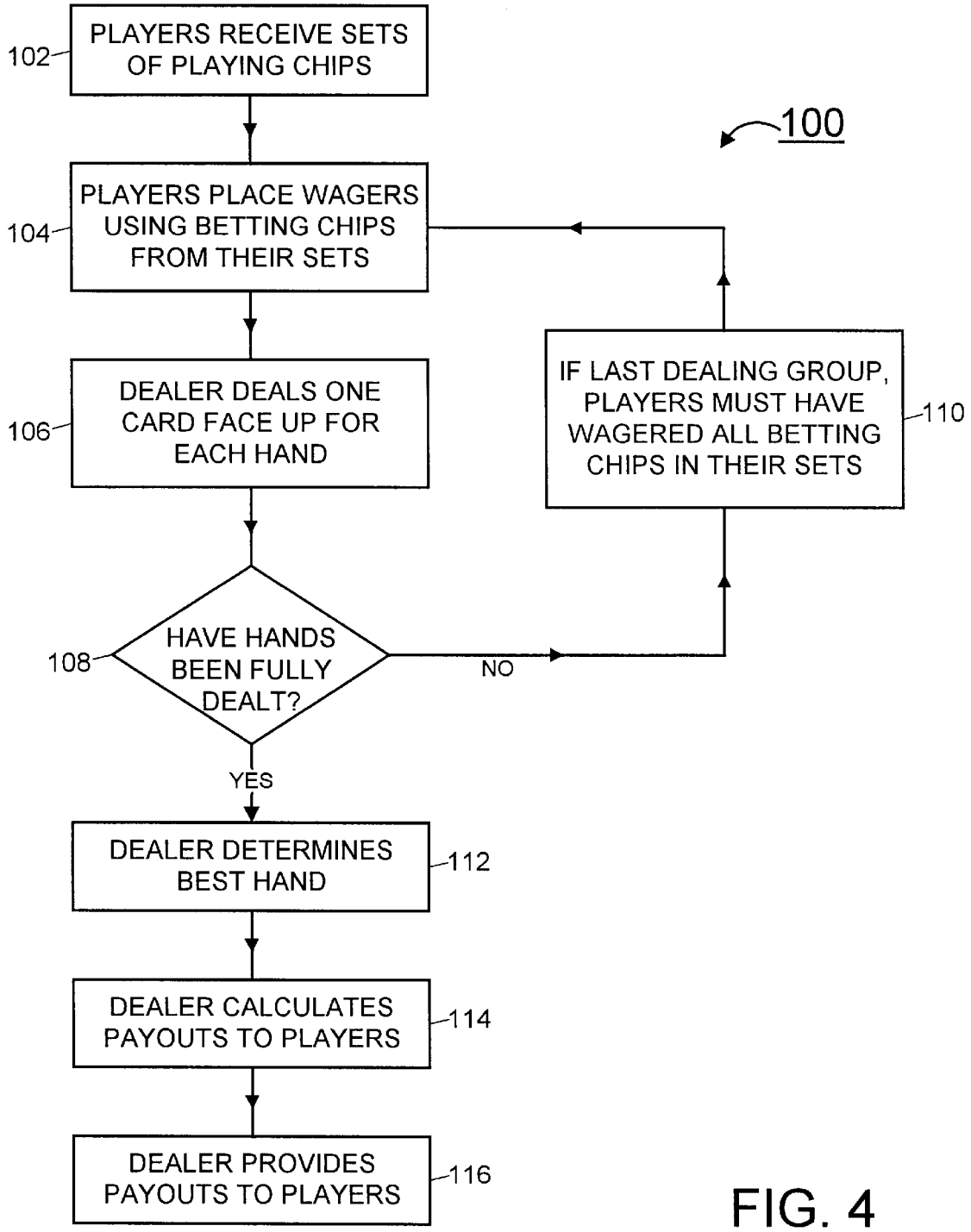
FIG. 4 is a flow chart showing a method of playing the game of the present invention.

FIG. 4 is a flow chart showing a method 100 of playing the poker wagering game of the present invention. Each player is provided with a set of betting chips (step 102). Each player may then place a wager, including an ante, on one of the hands H1,H2 . . . Hn which the player guesses will be the highest ranking hand using one or more of the betting chips from his set (step 104). The dealer deals a dealing group of cards from a deck of cards to form a predetermined number of hands, each hand receiving one card face up (step 106).

The steps of the player placing a wager (step 104) and dealer dealing a dealing group of cards on the hands (step 106) are repeated until all hands have been fully dealt (step 108). By the last dealing group, each player must have wagered any betting chips remaining in his set (step 110).

The dealer determines which is the best hand, i.e. the highest ranking hand according to standard poker rules (step 112). The dealer calculates the payout to players who placed wagers on the best hand based on when the players wagered their betting chips during play of the game (step 114), and provides the payout to those players (step 116).

The game of the present invention may be implemented as an electronic video or computer game to be played in a casino or other gaming establishment or even in a remote location, such as a player's home. The game may also be played via an electronic communications network, e.g., the internet.

Figure 5:
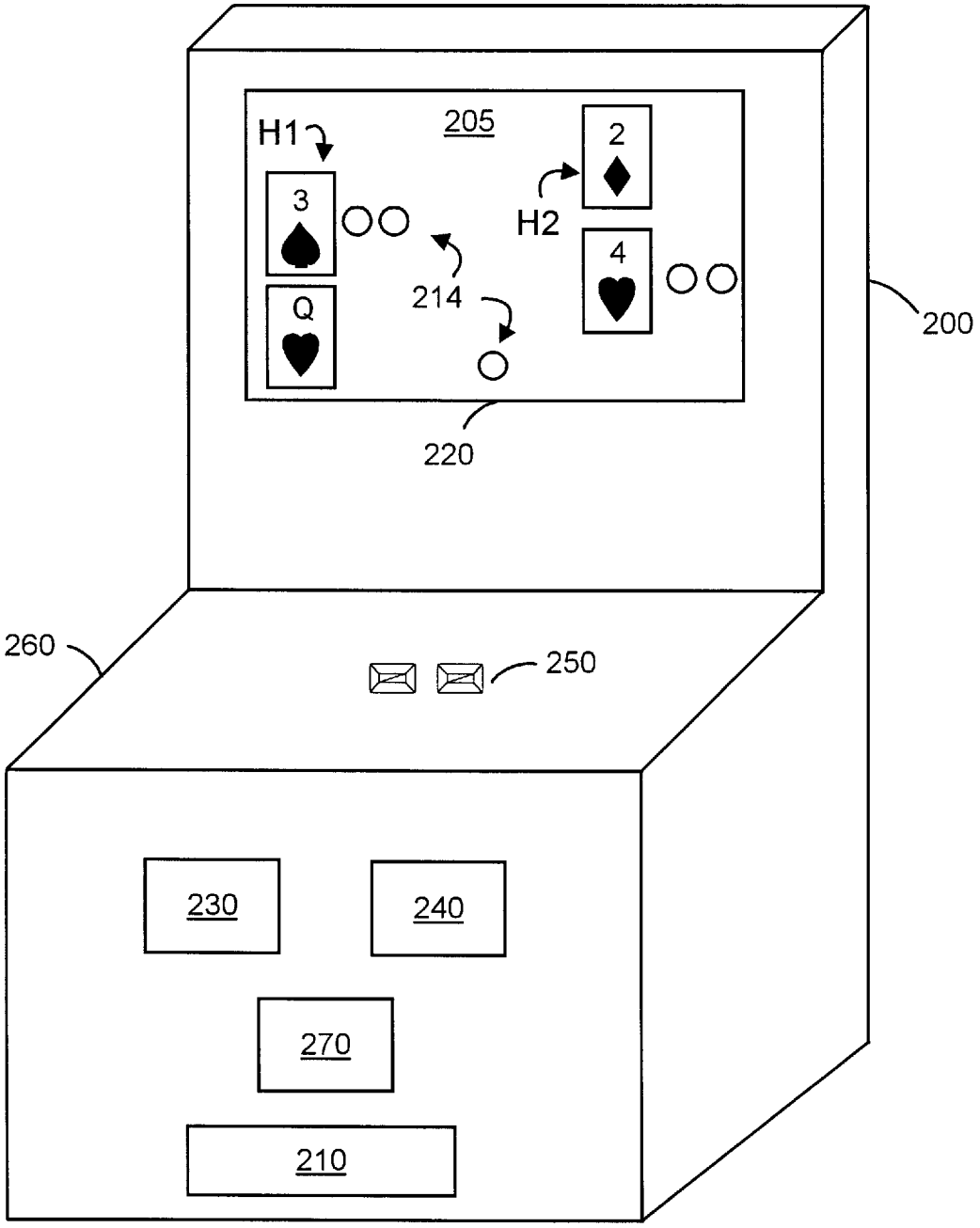
FIG. 5 is a somewhat diagrammatic sketch of an electronic gaming machine for playing the game of the present invention.

As shown in FIG. 5, the electronic game may include a processor 210 in a game machine 200. The player views a screen 220 showing the hands as they are dealt by processor 210 and the player's betting chips 214 as they are wagered during play of the game 205.

A player may play the poker wagering game of the present invention at game machine 200 by inserting a predetermined amount of money into a coin slot 230 or a bill collecting device 240. Once the predetermined amount of money has been inserted, the game commences and is displayed to the player on screen 220. An individual player may play against either processor 210 or against one or more imaginary players controlled by processor 210. Alternately, the player may play against one or more players at similar game machines in communication with game machine 200.

As processor 210 causes cards to be dealt during play of the game, the player wagers one or more of his set of betting chips on one of the hands being dealt by pressing buttons 250 on a console 260 of game machine 200, or by touching the betting chips on a touch-sensitive screen 220. Chips are moved to a location adjacent to the corresponding cards when they are wagered. Play then continues in this fashion until all of the hands have been fully dealt.

If the player at game machine 200 has placed any chips on the highest ranking hand, as determined when all of the hands have been fully dealt, processor 210 may calculate the payout based on when the player's betting chips were wagered during play of the game. The game machine 200 may either dispense the payout to the player through a payout dispenser 270 or credit an account maintained by processor 210 against which the player may play further games on game machine 200.

Other embodiments are within the scope of the following claims.

What is claimed is:

1. A method of playing a wagering game, comprising:

providing an initial set of betting chips;

dealing a quantity of cards from a deck of cards equal to a quantity of hands, each of the cards being dealt in one of a plurality of dealing groups to form the hands;

a player placing a wager on at least one of the quantity of hands based on a subset of the initial set of betting chips, the subset of wagering chips being removed from the initial set of wagering chips;

repeating the placing and dealing steps until a predetermined number of cards has been dealt in a number of dealing groups equal to the predetermined number to complete the hands;

determining which of the hands is the highest ranking hand; and calculating a payout to the player based on the sequence of dealing groups, the payout for each of the player's betting chips depending upon the dealing group for which the chip was wagered.

2. The method of claim 1 wherein each wager placed by the player may be placed on any one of the quantity of hands.

3. The method of claim 1 wherein each wager placed by the player may be placed on more than one of the quantity of hands.

4. The method of claim 1 wherein each wager placed by the player may be placed prior to one of the dealing groups.

5. The method of claim 1 wherein the highest ranking hand is determined according to standard poker rules.

6. The method of claim 1 wherein the payout for a betting chip wagered for a first dealing group is greater than the payout for a betting chip wagered for a final dealing group.

7. The method of claim 1 wherein the payout for a betting chip wagered for each dealing group is greater than the payout for a betting chip wagered for a next dealing group.

8. The method of claim 1 further comprising wagering a betting chip as an ante.

9. The method of claim 1 wherein the player must have wagered all of the initial set of betting chips prior to a final dealing group.

10. The method of claim 1 wherein the wagering game is a casino game.

11. The method of claim 1 wherein the wagering game is an electronic game.

12. The method of claim 1 wherein the deck of cards is a standard deck of 52 playing cards.

13. The method of claim 1 further comprising maintaining a progressive jackpot which is paid to the player if the player places a wager on a hand that includes a certain combination of cards.

14. The method of claim 1 wherein the cards are dealt by a dealer.

15. The method of claim 1 wherein the predetermined number is five.

16. The method of claim 1 wherein the quantity of hands is seven.

17. The method of claim 1 wherein the cards are dealt face up.

18. The method of claim 1 wherein the game is played by a plurality of players.

19. The method of claim 18 wherein all players start the game with the same number of betting chips.

20. An electronic gaming device for playing a wagering game, comprising:

a screen displaying an initial set of betting chips and cards dealt in a plurality of dealing groups to form a quantity of hands, one card being dealt to each hand in each dealing group until a predetermined number of cards has been dealt to the hands; and a processor for dealing the cards from a deck of cards, determining which of the hands is the highest ranking hand, calculating a payout, and providing the payout;

wherein a player places a wager on at least one of the quantity of hands based on a subset of the initial set of betting chips for each dealing group, the subset of wagering chips being removed from the initial set of wagering chips; and wherein the payout is calculated based on the sequence of dealing groups, the payout for each of the player's betting chips depending upon the dealing group for which the chip was wagered.

21. The electronic gaming device according to claim 20 wherein each wager placed by the player may be placed on any one of the quantity of hands.

22. The electronic gaming device according to claim 20 wherein each wager placed by the player may be placed on more than one of the quantity of hands.

23. The electronic gaming device according to claim 20 wherein each wager placed by the player may be placed prior to one of the dealing groups.

24. The electronic gaming device according to claim 20 wherein the highest ranking hand is determined according to standard poker rules.

25. The electronic gaming device according to claim 20 wherein the payout for a betting chip wagered for a first dealing group is greater than the payout for a betting chip wagered for a final dealing group.

26. The electronic gaming device according to claim 20 wherein the payout for a betting chip wagered for each dealing group is greater than the payout for a betting chip wagered for a next dealing group.

27. The electronic gaming device according to claim 20 wherein the player must have wagered all of the initial set of betting chips prior to a final dealing group.

28. The electronic gaming device according to claim 20 wherein the predetermined number is five.

29. The electronic gaming device according to claim 20 wherein the quantity of hands is seven.

* * * * *